US007863831B2

(12) United States Patent
Vos

(10) Patent No.: US 7,863,831 B2
(45) Date of Patent: Jan. 4, 2011

(54) AC ILLUMINATION APPARATUS WITH AMPLITUDE PARTITIONING

(75) Inventor: Martin J. Vos, Minneapolis, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 287 days.

(21) Appl. No.: 12/137,667

(22) Filed: Jun. 12, 2008

(65) Prior Publication Data

US 2009/0309505 A1 Dec. 17, 2009

(51) Int. Cl.
*H05B 37/02* (2006.01)

(52) U.S. Cl. ..... 315/291; 315/155; 315/205; 315/360

(58) Field of Classification Search ..... 315/149, 315/152, 155, 185 R, 185 S, 201–202, 205, 315/225, 246, 291, 307–309, 360
See application file for complete search history.

(56) References Cited

U.S. PATENT DOCUMENTS

| | | | | |
|---|---|---|---|---|
| 5,850,126 | A | 12/1998 | Kanbar | |
| 6,031,855 | A | 2/2000 | Watanabe | |
| 6,211,626 | B1 | 4/2001 | Lys et al. | |
| 6,495,964 | B1 * | 12/2002 | Muthu et al. | 315/149 |
| 6,567,009 | B2 | 5/2003 | Ohishi et al. | |
| 6,577,072 | B2 | 6/2003 | Saito et al. | |
| 6,577,080 | B2 | 6/2003 | Lys et al. | |
| 6,744,223 | B2 * | 6/2004 | Laflamme et al. | 315/291 |
| 6,853,150 | B2 | 2/2005 | Clauberg et al. | |
| 6,888,529 | B2 * | 5/2005 | Bruning et al. | 345/102 |
| 6,963,175 | B2 | 11/2005 | Archenhold et al. | |
| 7,038,399 | B2 | 5/2006 | Lys et al. | |
| 7,140,752 | B2 | 11/2006 | Ashdown | |
| 7,190,125 | B2 | 3/2007 | McDonough et al. | |
| 7,202,613 | B2 | 4/2007 | Morgan et al. | |
| 7,508,143 | B2 * | 3/2009 | Suzuki | 315/291 |
| 2002/0047628 | A1 | 4/2002 | Morgan et al. | |
| 2002/0101197 | A1 | 8/2002 | Lys et al. | |
| 2002/0105286 | A1 * | 8/2002 | Brownell | 315/291 |
| 2002/0158583 | A1 | 10/2002 | Lys et al. | |
| 2002/0158590 | A1 | 10/2002 | Saito et al. | |
| 2003/0028260 | A1 | 2/2003 | Blackwell | |
| 2003/0122502 | A1 | 7/2003 | Clauberg et al. | |
| 2004/0051474 | A1 * | 3/2004 | Wong | 315/291 |
| 2005/0218870 | A1 | 10/2005 | Lys | |
| 2005/0253533 | A1 | 11/2005 | Lys et al. | |
| 2006/0108933 | A1 | 5/2006 | Chen | |
| 2006/0237636 | A1 * | 10/2006 | Lyons et al. | 250/228 |
| 2006/0262545 | A1 | 11/2006 | Piepgras et al. | |

(Continued)

FOREIGN PATENT DOCUMENTS

| | | |
|---|---|---|
| DE | 10230105 | 7/2002 |

(Continued)

*Primary Examiner*—Douglas W Owens
*Assistant Examiner*—Tung X Le

(57) ABSTRACT

A method includes rectifying AC power and controlling switching of first, second and third currents from and rectified power and a switching sequence that is locked to the AC cycle time by sensing an amplitude of at least one of the AC power and the rectified power. The first, second and third currents are conducted through corresponding first, second and third series of color light emitting devices of different colors. The switching sequence repeats at least twice each AC cycle time.

20 Claims, 12 Drawing Sheets

U.S. PATENT DOCUMENTS

| | | | | |
|---|---|---|---|---|
| 2006/0268236 | A1 | 11/2006 | Prince | |
| 2006/0273741 | A1 | 12/2006 | Stalker, III | |
| 2007/0064421 | A1 | 3/2007 | Baba | |
| 2007/0080652 | A1 | 4/2007 | Elferich et al. | |
| 2007/0114951 | A1* | 5/2007 | Tsen et al. | 315/291 |
| 2007/0115665 | A1 | 5/2007 | Mueller et al. | |
| 2007/0210722 | A1* | 9/2007 | Konno et al. | 315/185 S |

FOREIGN PATENT DOCUMENTS

| | | |
|---|---|---|
| EP | 0 704 912 | 4/1996 |
| EP | 1 176 849 | 1/2002 |
| JP | 58-028879 | 2/1983 |
| JP | 11-115241 | 4/1999 |
| JP | 11-329721 | 11/1999 |
| JP | 2007-080771 | 3/2007 |
| JP | 2007-322944 | 12/2007 |
| WO | WO 99/10867 | 3/1999 |
| WO | WO 01/15193 | 3/2001 |
| WO | WO 01/45470 | 6/2001 |
| WO | WO 02/10847 | 2/2002 |
| WO | WO 02/25842 | 3/2002 |
| WO | WO 02/35889 | 5/2002 |
| WO | WO 02/091805 | 11/2002 |
| WO | WO 03/06761 | 1/2003 |
| WO | WO 03/026358 | 3/2003 |
| WO | WO 03/055273 | 7/2003 |
| WO | WO 2005/006818 | 1/2005 |
| WO | WO 2005/011006 | 2/2005 |
| WO | WO 2005/048658 | 5/2005 |
| WO | WO 2006/023149 | 3/2006 |
| WO | WO 2006/081186 | 8/2006 |
| WO | WO 2006/090535 | 8/2006 |

* cited by examiner

AC ILLUMINATION APPARATUS WITH AMPLITUDE PARTITIONING

BACKGROUND OF THE INVENTION

Various types of illumination apparatus are known such as incandescent bulbs, fluorescent bulbs and light emitting diode (LED) bulbs. LED bulbs are capable of efficient light generation, however the light generated is not ideally matched to illumination applications and not ideally matched to efficient energization from AC power mains. LEDs tend to produce Lambertian light beams rather than widely diffused illumination. LEDs tend to produce light in narrow spectral bands rather than broad spectrum white illumination. LEDs have DC operating voltages that are typically a few volts and can't be directly connected to AC mains power in the range of 100-250 volts. A method and apparatus are needed to better adapt LEDs for use in illumination applications.

SUMMARY OF THE INVENTION

Disclosed is a method that comprises rectifying an AC voltage from an AC power source with an AC cycle time to provide rectified voltage. The method further comprises controlling switching of at least first, second and third currents from the rectified power. The switching has a switching sequence that is locked to the AC cycle time by sensing an amplitude of at least one of the AC voltage and the rectified voltage. The method comprises conducting the first, second and third currents through corresponding first, second and third series of color light emitting devices that emit an illumination sequence of corresponding first, second and third color emissions. Each color emission repeats at least twice each AC cycle time.

Also disclosed is an illumination apparatus that comprises a rectifier circuit that couples to AC power with an AC cycle time. The rectifier circuit provides a rectified voltage. The apparatus comprises a switching circuit that switches at least first, second and third currents. The switching is controlled by sensing an amplitude of at least one of the AC voltage and the rectified voltage. The apparatus comprises at least first, second and third series of color light emitting devices that receive the corresponding first, second and third currents. The first, second and third series of color light emitting devices emit a sequence of corresponding first, second and third color emissions that repeats at least twice each AC cycle time.

According to one aspect, the illumination apparatus comprises a switch control circuit with a voltage sense input coupled to one of the AC voltage and the rectified voltage. The switch control circuit provides switch control outputs that are locked to the AC cycle time.

DETAILED DESCRIPTION OF ILLUSTRATIVE EMBODIMENTS

In the embodiments described below, an illumination apparatus is disclosed that includes a multicolor (RGB) bulb that includes series strings of color light emitting devices and a dimmer for controlling the intensity and chromaticity of the illumination. The illumination is controlled as a function of an amplitude of AC mains power.

Figure 1:
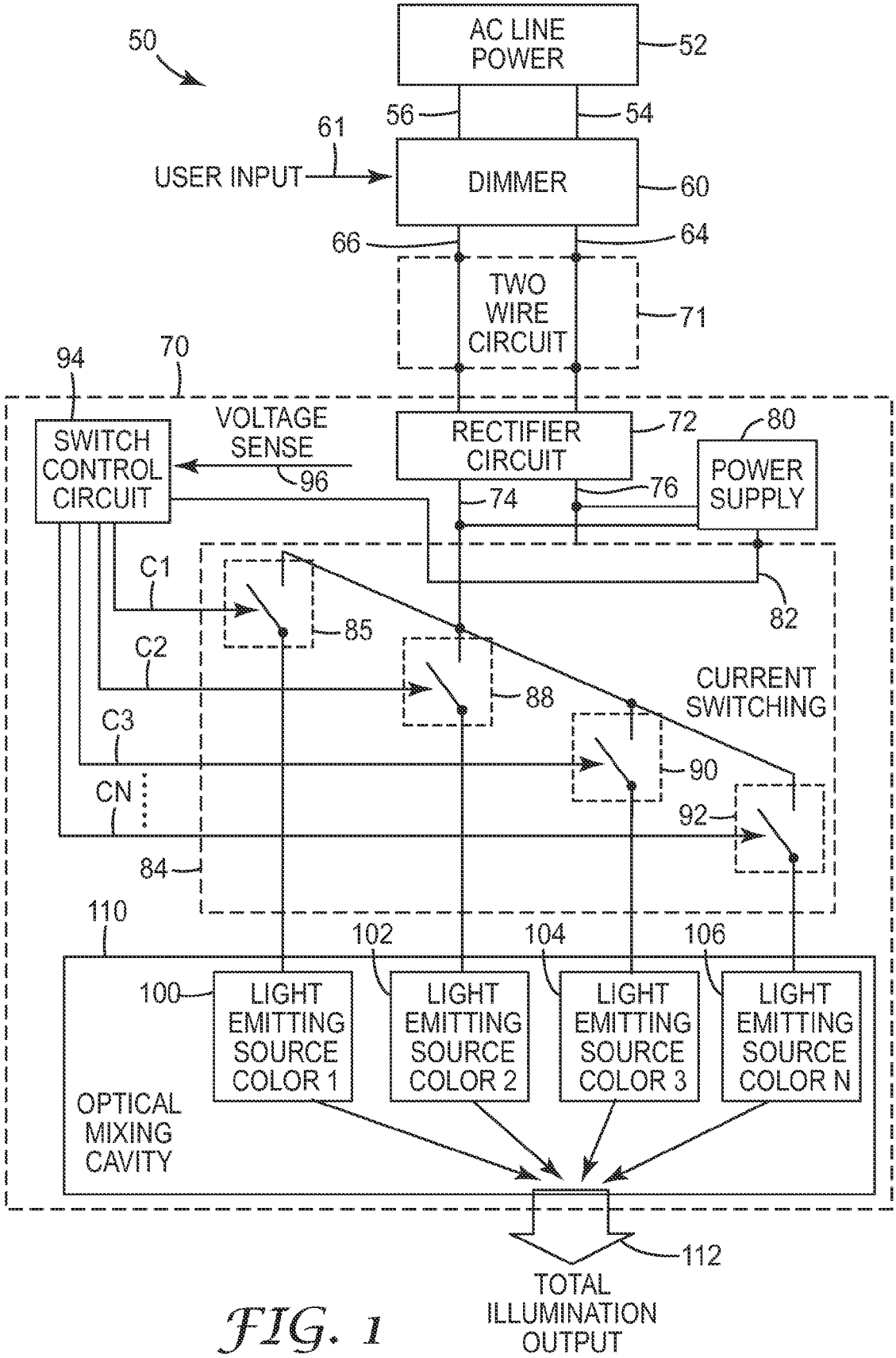
FIG. 1 illustrates a block diagram of an illumination system.

FIG. 1 illustrates a block diagram of an illumination system 50. The illumination system 50 is energized by AC power (as illustrated in waveform 902 at the top of FIG. 9) from an AC power line 52. The AC power line 52 provides AC power on two conductors 54, 56 from an AC power distribution panel or any other known source of AC power. According to one aspect, the AC power comprises 50 Hz or 60 Hz sine wave AC power. According to another aspect, one of the two AC power conductors 54, 56 is optionally grounded. The AC power provided, from time to time, includes line voltage variations and noise.

The illumination system 50 includes a circuit 60 that is referred to here as an "RGB dimmer" 60. The RGB dimmer 60 is connected to AC power conductors 54, 56 and is energized by AC power conductors 54, 56. The circuitry of the RGB dimmer 60 is described in more detail below by way of example schematics illustrated in FIGS. 2 and 4 and example timing diagrams illustrated in FIGS. 8-9. The RGB dimmer 60 provides a modified AC power output on lines 64, 66. The modified AC power output on lines 64, 66 comprises a waveform that is switched on and off within a sinusoidal AC envelope as described below in connection with the example timing diagrams in FIGS. 8-9. The on and off switching of the modified AC power output on lines 64, 66 is controlled as a function of an amplitude of the AC power provided on AC power conductors 54, 56 as described below in connection with the example timing diagrams in FIGS. 8-9. The on and off switching of the modified AC power output on lines 64, 66, in addition to providing power, also provides certain amplitude information in the switching that is based on the amplitude of the AC power, which is explained in more detail below.

According to one aspect, a user input 61 is provided on the RGB dimmer 60 to permit a user to adjust timing and to thereby adjust brightness or color of light emitted by an "RGB bulb" circuit 70.

The illumination system 50 includes the circuit 70. The "RGB bulb" circuit 70 is connected to the modified AC power output on lines 64, 66. The RGB bulb 70 is energized exclusively from the lines 64, 66. The lines 64, 66 are connected to the RGB bulb circuit 70 by a two wire circuit 71. The two wire circuit 71 includes the two current carrying conductors 64, 66 which carry both energization (power) and amplitude information to the RGB bulb circuit 70.

According to one aspect, the RGB bulb circuit 70 comprises a bulb with a screw contact base that fits into a bulb socket in a lamp base (such as an Edison socket), and the two wire circuit 71 comprises an ordinary lamp cord that connects to the bulb socket and that plugs into an ordinary electric outlet or the RGB dimmer 60. According to another aspect, the conductors 54, 56 comprise a lamp cord that plugs into an ordinary electrical outlet of the AC power line 52. It is understood by those skilled in the art that the lamp cords optionally include safety grounding conductors that are not energized and that do not carry energization currents under normal conditions.

The RGB bulb circuit 70 comprises a rectifier circuit 72 that couples to the lines 64, 66. The rectifier circuit 72 rectifies modified AC power output on lines 64, 66 and provides a full wave rectified output on lines 74, 76. The on and off switching that is present on lines 64, 66 is also present in rectified form in the full wave rectified output on lines 74, 76.

The RGB bulb circuit 70 comprises a low voltage power supply 80. The power supply 80 is energized by the full wave rectified output on lines 74, 76. The power supply 80 provides low voltage DC power (typically 5-15 volts DC or other logic level voltage) on line 82 for energizing a current switching circuit 84 and a switch control circuit 94. The RGB bulb circuit 70 comprises the current switching circuit 84 and the switch control circuit 94. The switching circuit 84 comprises solid state switches 85, 88, 90, 92. Line 82 couples to switching circuit 84 to provide DC energization for the switches 85, 88, 90, 92.

The switch control circuit 94 senses AC power voltage on line 96. According to one aspect, line 96 of the switch control circuit 94 senses rectified AC power voltage at conductors 74, 76. According to another aspect, line 96 of the switch control circuit 94 senses unrectified AC power voltage at an input to rectifier 72 (lines 64, 66). The switch control circuit 94 derives amplitude information from the amplitude of the sensed AC power voltage on line 96. The switch control circuit 94 provides logic level switch control outputs C1, C2, C3, . . . , CN respectively to control inputs of the switches 85, 88, 90, 92 as illustrated. The switching of the logic level switch control outputs C1, C2, C3, . . . CN is controlled as a function of the sensed amplitude on line 96. According to one aspect, the logic level switch control outputs C1, C2, C3, . . . , CN are on during non-overlapping amplitude intervals such that only one control output C1, C2, C3, . . . , CN is on at a time.

The RGB bulb circuit 70 comprises light emitting sources 100, 102, 104, 106. Each such light emitting source in RGB bulb circuit 70 comprises a series circuit (string) of light emitting devices. The light emitting devices can be light emitting diodes (LEDs) including organic LEDs (OLEDs), or other color light emitting devices that operate at low voltages such as less than a few volts. Various types of low voltage color electroluminescent devices can be used. The light emitting sources 100, 102, 104, 106 are energized (turned on) during non-overlapping amplitude intervals. Rectified power on line 74 is connected through switches 85, 88, 90, 92 to light emitting sources 100, 102, 104, 106 under the control of switch control outputs C1, C2, C3, . . . , CN as illustrated. Each of the light emitting sources 100, 102, 104, 106 emits light in a different portion of the visible spectrum and is turned on at a different time with respect to another light emitting source.

Light emitted by the light emitting sources 100, 102, 104, 106 is injected into an optical cavity 110. The optical cavity 110 manages the light emitted into a total illumination output 112. The managing of the emitted light comprising directing the emitted light from the multiple strings together with one another so that a uniform mixture of the multiple colors is provided for substantially all directions of illumination outputs. There is a common output illumination path for the multiple colors. The managing of emitted light avoids distracting color fringes due to non-uniform mixing. According to one aspect, the optical cavity 110 comprises one or more light diffusers. According to another aspect, the total illumination output 112, as viewed from a particular viewing angle or direction, includes R, G and B light emitted from all of the light emitting sources 100, 102, 104, 106. According to another aspect, the optical cavity 110 has a shape like a light bulb, and the electronic circuitry in RGB bulb circuit 70 is inside the light bulb shape of optical cavity 110.

According to one aspect, the RGB bulb circuit 70 comprises a red (R) light emitting source, a green (G) light emitting source and a blue (B) light emitting source. During each half cycle of the AC power, the color sequence B-R-G-G-R-B is emitted. During each full cycle of the AC power, the color sequence B-R-G-G-R-B-B-R-G-G-R-B is emitted. The persistence of vision in humans is long enough so that the color sequence R-G-B-R-G-B during a full cycle of 50 or 60 Hz power is perceived as a mixture of the colors R, G, B, even though there is no simultaneous mixture of the colors R, G, B present. According to this aspect, the RGB bulb circuit 70 provides illumination that is perceived as illumination with a color in the range of white illumination. According to one aspect, the repetition frequency of the color sequence is high enough to exceed a critical flicker frequency according to the Talbot-Plateau law. According to another aspect the repetition frequency of the color sequence is high enough to exceed a critical chromatic flicker frequency, usually lower than the critical flicker frequency.

Figure 2:
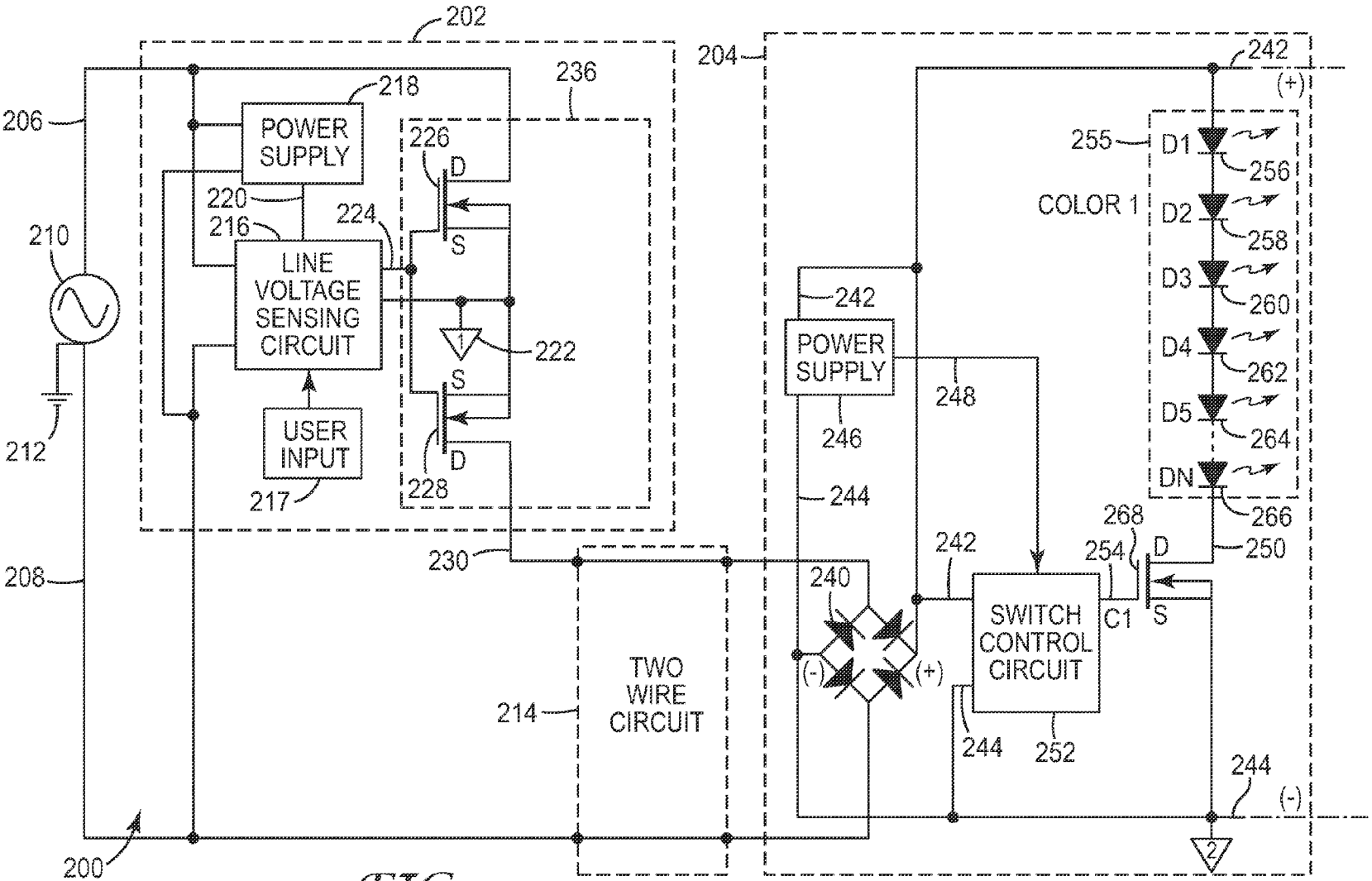
FIG. 2 illustrates a first partial schematic diagram of an illumination system.
Figure 3:
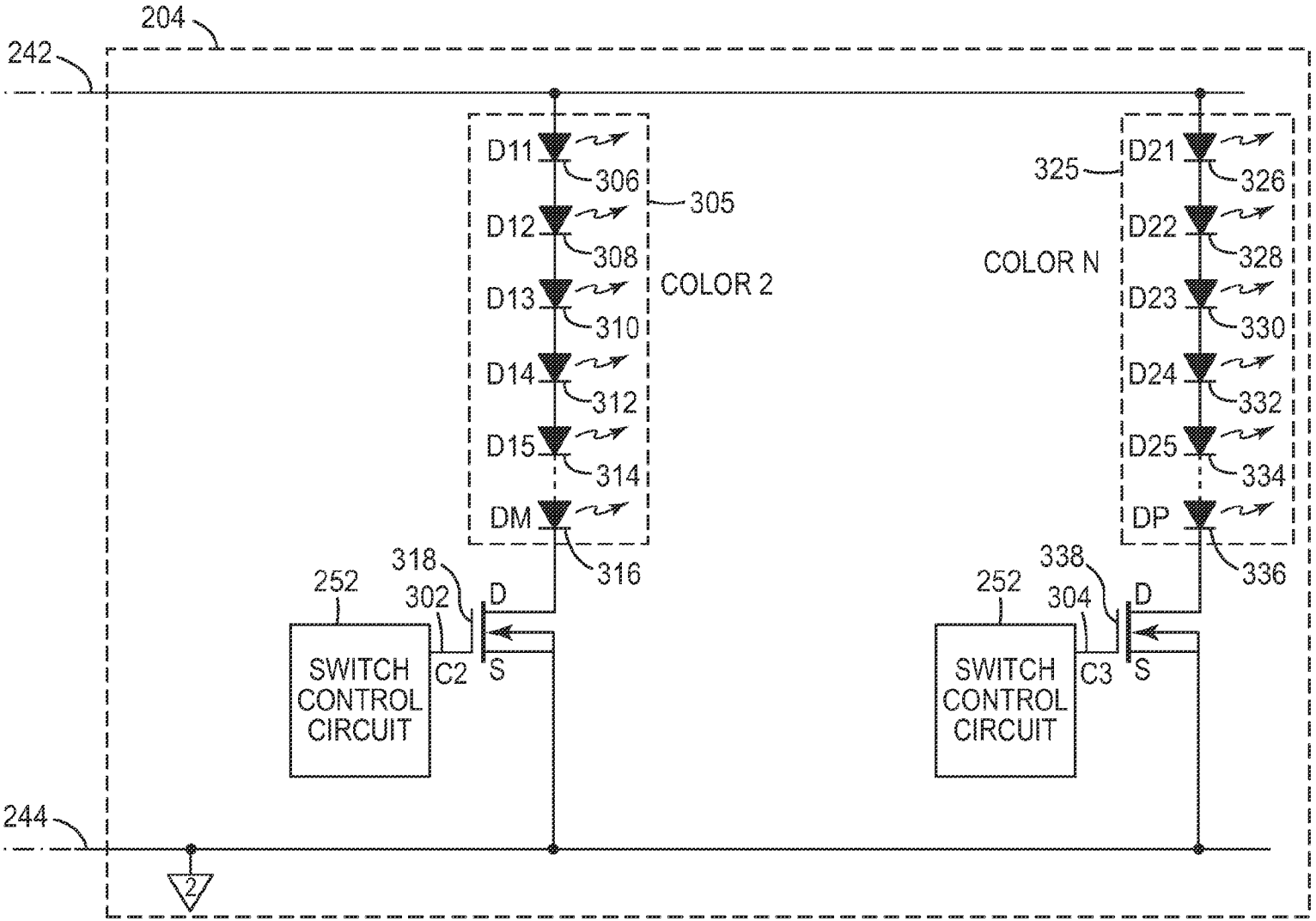
FIG. 3 illustrates a second partial schematic diagram of an illumination system.

FIG. 2 illustrates a first partial schematic diagram of an illumination system 200. The illumination system 200 comprises an RGB dimmer 202 and an RGB bulb 204. Only a partial schematic of the RGB bulb 204 is illustrated in FIG. 2, and remaining portions of the schematic of the RGB bulb 200 are shown in FIG. 3. A complete schematic of the illumination system 200 can be seen by arranging FIG. 2 on a left side of FIG. 3. The RGB dimmer 202 is energized by AC power on conductors 206, 208 that are connected to an AC power line 210.

According to one aspect, conductor 208 is optionally connected through AC power line 210 to an earth ground 212 and comprises a grounded conductor. The grounded conductor 208 extends through a two wire circuit 214 to the RGB bulb 204.

The RGB dimmer 202 comprises a line voltage sensing circuit 216. The line voltage sensing circuit 216 senses line voltage at conductors 206, 208. According to one aspect, the line voltage sensing circuit 216 comprises a user input 217 for adjustment of voltage amplitude levels for switching, which are described in more detail below by way of an example timing diagram illustrated in FIGS. 8-9.

The RGB dimmer 202 comprises a low voltage power supply 218. The power supply 218 is energized by the line voltage at conductors 206, 208. The power supply 218 generates a logic level DC supply voltage (such as 5-15 volts, for example) between a conductor 220 and a reference conductor 1 (also called DC common 1) 222. The logic level DC supply voltage is coupled to the line voltage sensing circuit 216 and energizes the line voltage sensing circuit 216. The line voltage sensing circuit 216 generates a switch control output 224.

The RGB dimmer 202 comprises a first MOSFET transistor 226 and a second MOSFET transistor 228. The switch control output 224 couples to input gates of the first and second MOSFET transistors 226, 228. According to one aspect, both transistors 226, 228 are N-channel depletion mode MOSFETs. Each of the MOSFET transistors 226, 228 comprises a source (S) that is connected to the reference 1 conductor 222. The MOSFET transistor 226 has a drain (D) that is connected to AC power conductor 206. The MOSFET transistor 228 has a drain (D) that is connected to a conductor 230 that couples to the RGB bulb 204 by way of the two wire circuit 214. It will be understood by those skilled in the art that the MOSFET transistors 226, 228, when reverse biased, have an internal structure (e.g., connection of the transistor source (S) to the transistor substrate) that functions as a rectifier diode between drain (D) and source (S) such that the MOSFET transistors 226, 228 conduct current when reverse biased. The MOSFET transistors 226, 228 are not damaged by reverse bias currents. When both MOSFET transistors 226, 228 are OFF, there is no current flow through the MOSFET transistors 226, 228. When both MOSFET transistors 226, 228 are ON, current of both polarities can flow through first and second MOSFET transistor 226, 228. The circuit arrangement of the first and second MOSFET transistors 226, 228 functions as a solid state AC switch 236. This AC switch 236 does not latch until a zero current crossing like an SCR or TRIAC would. The AC switch 236 does not require a zero current crossover for commutation. This AC switch 236 can be used to switch line voltage (e.g., 117 VAC or 234 VAC) circuits ON and OFF without latch up as described in more detail below in connection with FIGS. 8-9. As a result, the ON/OFF switching remains controllable at any amplitude of the sinewave AC power.

The conductors 230, 208 form the two wire circuit 214 that supplies energy to the RGB bulb 204. The conductor 208 can be optionally grounded at ground 212 and can include an outer metal screw base shell inside a lamp socket into which the RGB bulb 204 is installed.

The RGB bulb 204 comprises a full wave bridge rectifier 240. The bridge rectifier 240 receives AC energization on conductors 208, 230 and provides rectified energization on conductors 242, 244. The rectified energization on conductors 242, 244 is coupled to a power supply 246. The power supply 246 generates a logic level (e.g., 5-15 volt) DC voltage on conductor 248 referenced to conductor reference 2 (also called DC common 2) 244. The local conductor reference 2 at 244 in the RGB bulb 204 is not the same as the local conductor reference 1 at 222 in the RGB dimmer 202.

The RGB bulb 204 comprises a switch control circuit 252. The switch control circuit 252 is energized by the power supply 246. The switch control circuit 252 senses the amplitude of the rectified voltage on conductors 242, 244. The switch control circuit 252 provides a switch control output C1 at 254. The operation of the switch control circuit 252 is described in more detail below in connection with an example timing diagram illustrated in FIGS. 8, 9.

The RGB bulb 204 comprises a first series circuit 255 comprising light emitting diodes 256, 258, 260, 262, 264, 266 which emit light of a first color (COLOR 1). An n-channel, depletion mode MOSFET transistor 268 comprises a drain (D) and a source (S) connected in series with the first series circuit 255. A gate of the MOSFET transistor 268 receives the switch control output C1 at 254. It will be understood by those skilled in the art that series circuits of LED's (such as first series circuit 255) typically include a certain number (M, N and P) of LED's consistent with the actual voltage amplitude window when the series string is switched ON.

Only a partial schematic of the RGB bulb 204 is illustrated in FIG. 2. A right edge of FIG. 2 can be positioned adjacent a left edge of FIG. 3 to form a complete schematic diagram. Conductors (lines) 242, 244 extend from FIG. 2 to FIG. 3. Additional portions of the switch control circuit 252 in FIG. 2 are shown in duplicate in FIG. 3 for clarity. As illustrated in FIG. 3, the switch control circuit 252 generates switch control output C2 at 302 and switch control output C3 at 304.

The RGB bulb 204 comprises a second series circuit 305 comprising light emitting diodes 306, 308, 310, 312, 314, 316 which emit light of a second color (COLOR 2). An n-channel, depletion mode MOSFET transistor 318 comprises a drain (D) and a source (S) connected in series with the second series circuit 305. A gate of the MOSFET transistor 318 receives the switch control output C2 at 302.

The RGB bulb 204 comprises a third series circuit 325 comprising light emitting diodes 326, 328, 330, 332, 334, 336 which emit light of a third color (COLOR 3). An n-channel, depletion mode MOSFET transistor 338 comprises a drain (D) and a source (S) connected in series with the third series circuit 325. A gate of the MOSFET transistor 338 receives the switch control output C3 at 304.

The three colors COLOR 1, COLOR 2, COLOR 3 are different from one another, and each of the three colors can be turned ON for selected amplitude windows to produce a desired perception of a visible color of illumination. The three colors COLOR 1, COLOR 2, COLOR 3 are produced in an optical mixing cavity.

Figure 4:
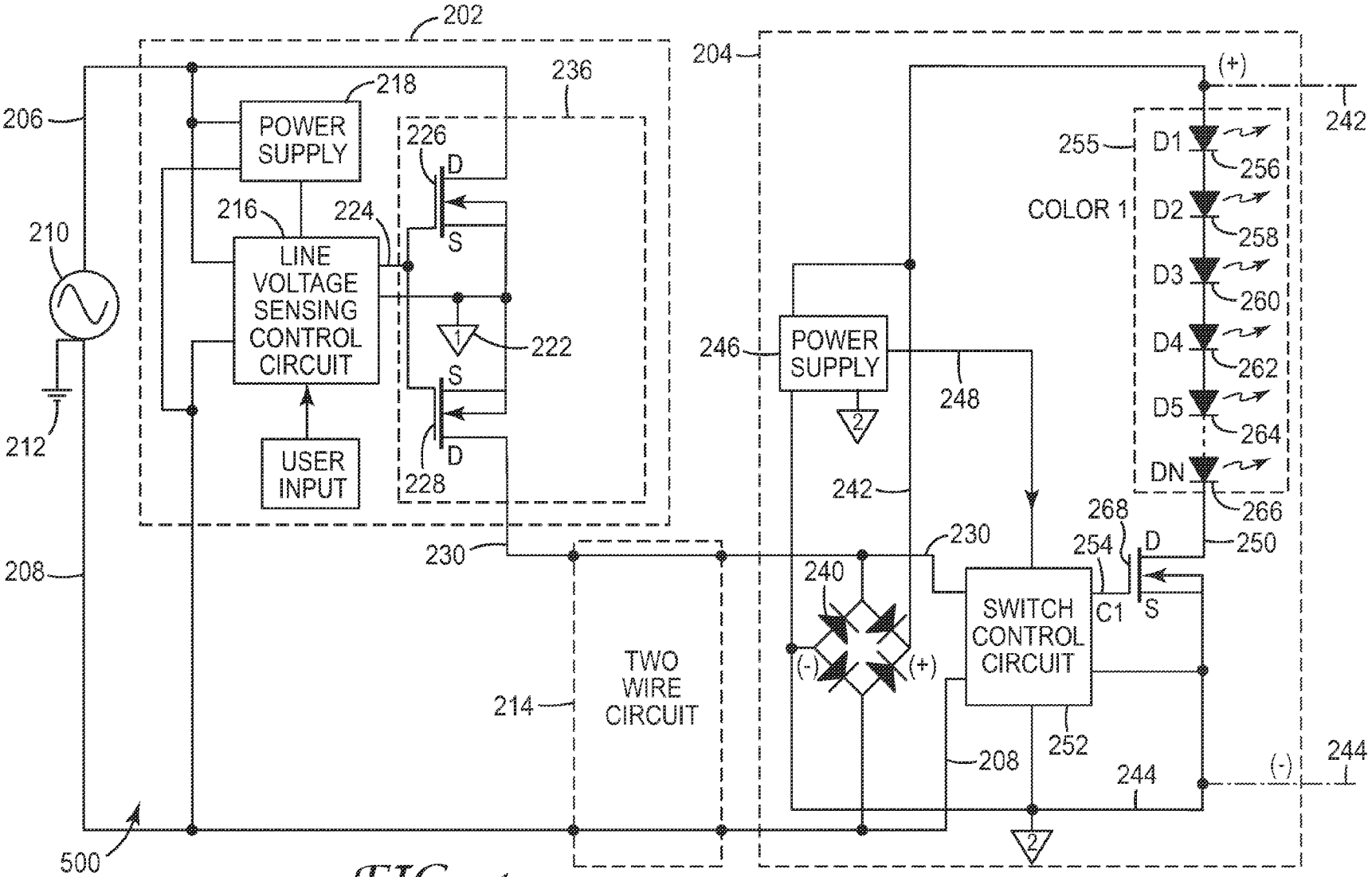
FIG. 4 illustrates a third partial schematic diagram of an illumination system.
Figure 5:
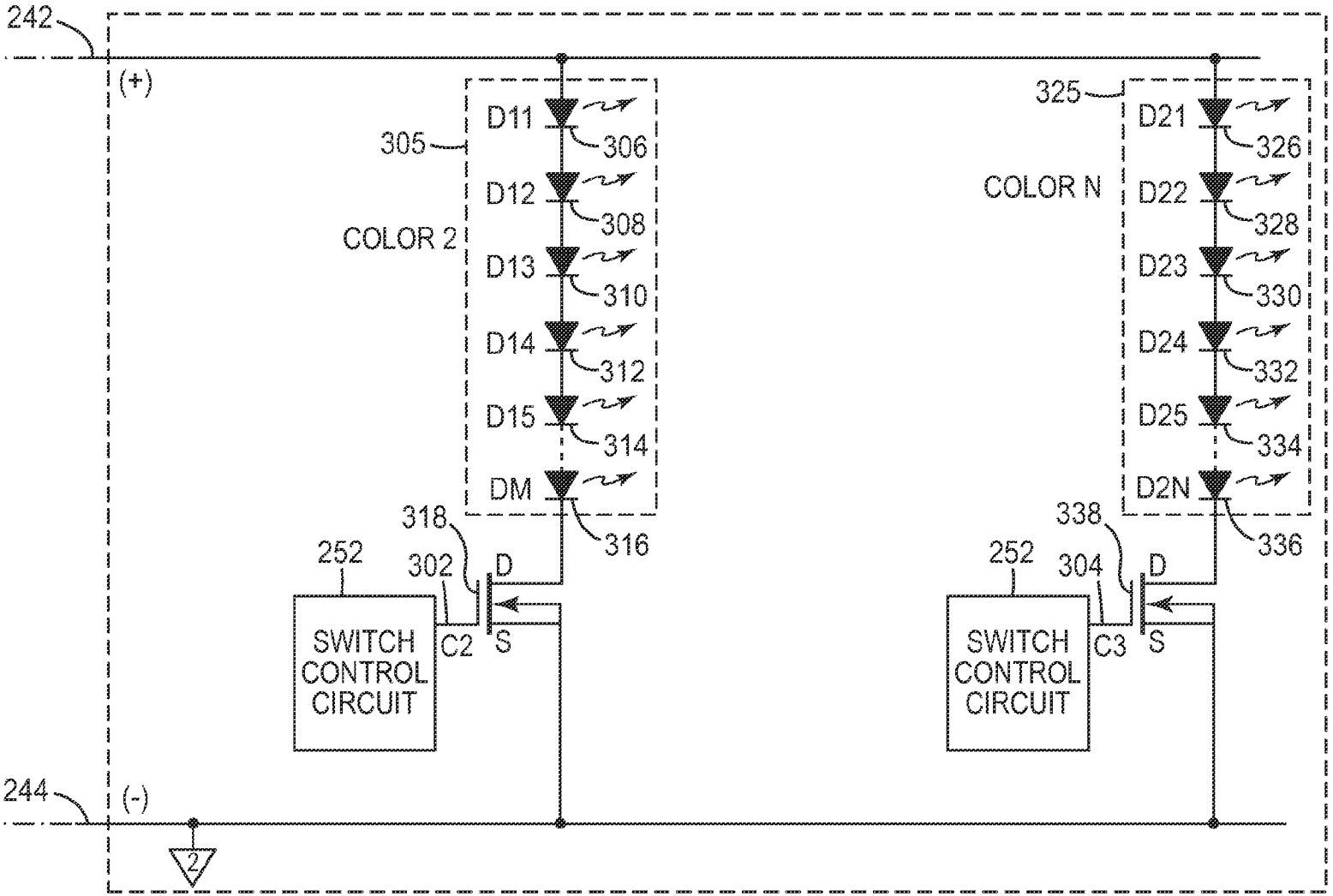
FIG. 5 illustrates a fourth partial schematic diagram of an illumination system.

FIGS. 4-5, taken together, illustrate a schematic diagram of an illumination system 500. The illumination system 500 is similar in many respects to the illumination system illustrated in FIGS. 2-3. References numbers used in FIGS. 4-5 that are the same as the reference numbers used in FIGS. 2-3 represent the same or similar elements. In FIGS. 2-3, the switch control circuit 252 senses rectified power on conductors 242, 244. In FIGS. 4-5, however, the switch control circuit 252 senses unrectified AC power on lines 208, 230. In other respects, the schematics diagrams in FIGS. 4-5 are similar to the schematic diagrams in FIGS. 2-3.

Figure 6:
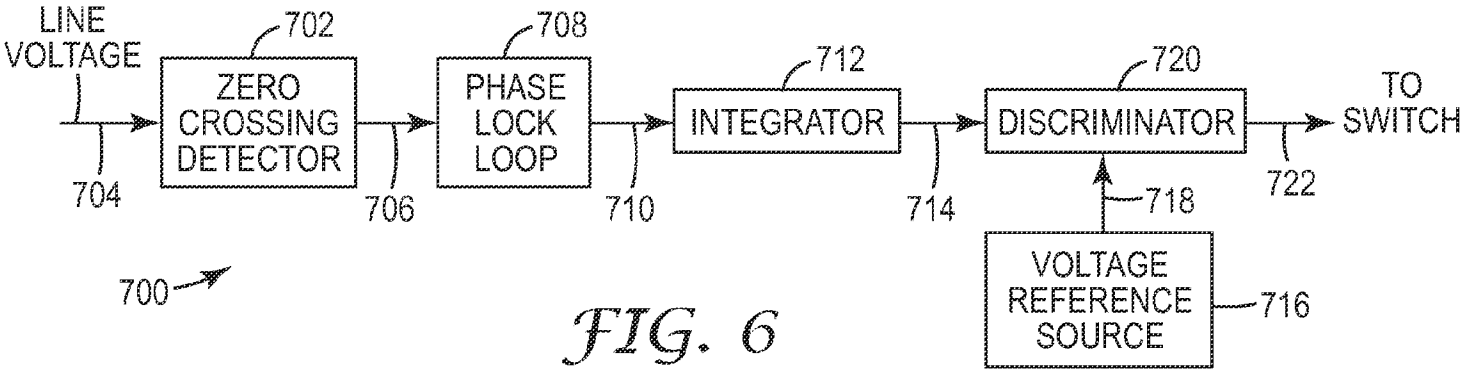
FIG. 6 illustrates a block diagram of a first switch control circuit.

FIG. 6 illustrates a block diagram of a first line voltage sensing circuit 700. The line voltage sensing circuit 700 comprises an exemplary circuit for use as the line voltage sensing circuit 216 in FIGS. 2, 4. Alternatively, the first line voltage sensing circuit 700 comprises an exemplary circuit for use in FIG. 4 as the switch control circuit 252 which senses AC line voltage on lines 208, 230 in FIG. 4.

The line voltage sensing circuit 700 comprises a zero crossing detector 702. The zero crossing detector 702 receives AC line voltage at an input 704. According to one aspect, the AC line voltage at input 704 comprises sine wave AC line voltage. According to another aspect, the AC line voltage at input 704 comprises a switched waveform that fits within an envelope of a sine wave AC voltage as described in more detail in an example timing diagram in FIGS. 8-9. The zero crossing detector 702 provides a zero crossing detector output 706 that has transitions (waveform edges) at times when zero amplitude crossings are detected.

The switching circuit 700 comprises a digital phase lock loop 708. The phase lock loop 708 senses the zero crossing detector output 706 and generates a phase lock loop output 710. According to one aspect, the phase lock loop output 710 comprises a rectangular waveform at double (100/120 Hz) of the AC line voltage frequency (50/60 Hz) and comprises the zero-crossing timing information of the detected AC line voltage.

The switching circuit 700 comprises an integrator 712. The integrator 712 receives the phase lock loop output 710. The integrator 712 generates an integrator output 714 that represents an integral of the phase lock loop output 710. According to one aspect, the integrator output 714 comprises a repetitive triangular waveform at double the AC line voltage frequency and comprises the zero crossing timing information of the detected AC line voltage.

The line voltage sensing circuit 700 comprises a voltage reference source 716. The voltage reference source 716 generates at least one voltage reference level 718. According to one aspect, the voltage reference level 718 has a relatively fixed level within the range of the integrator output 714 such that there are repetitive crossings of the integrator output 714 with the voltage reference level 718.

The line voltage sensing circuit 700 comprises a discriminator circuit 720. The discriminator circuit 720 receives the integrator output 714 and the voltage reference level 718 (or multiple voltage references) from the voltage reference source 716. According to one aspect, the discriminator circuit 720 comprises comparators, biasing circuits, voltage dividers and associated circuitry for comparing the integrator output 714 to the voltage reference level 718 (or multiple voltage references). The discriminator circuit 720 generates a switch control output 722. The switch control output 722 includes transitions that indicate a crossing of the integrator output 714 with the voltage reference level 718. In an instance where the line voltage sensing circuit 700 is used in FIG. 4 as the switch control circuit 252, the discriminator 720 receives multiple voltage references 718 and provides multiple control outputs 722 as control outputs C1, C2, C3, CN.

Figure 7:
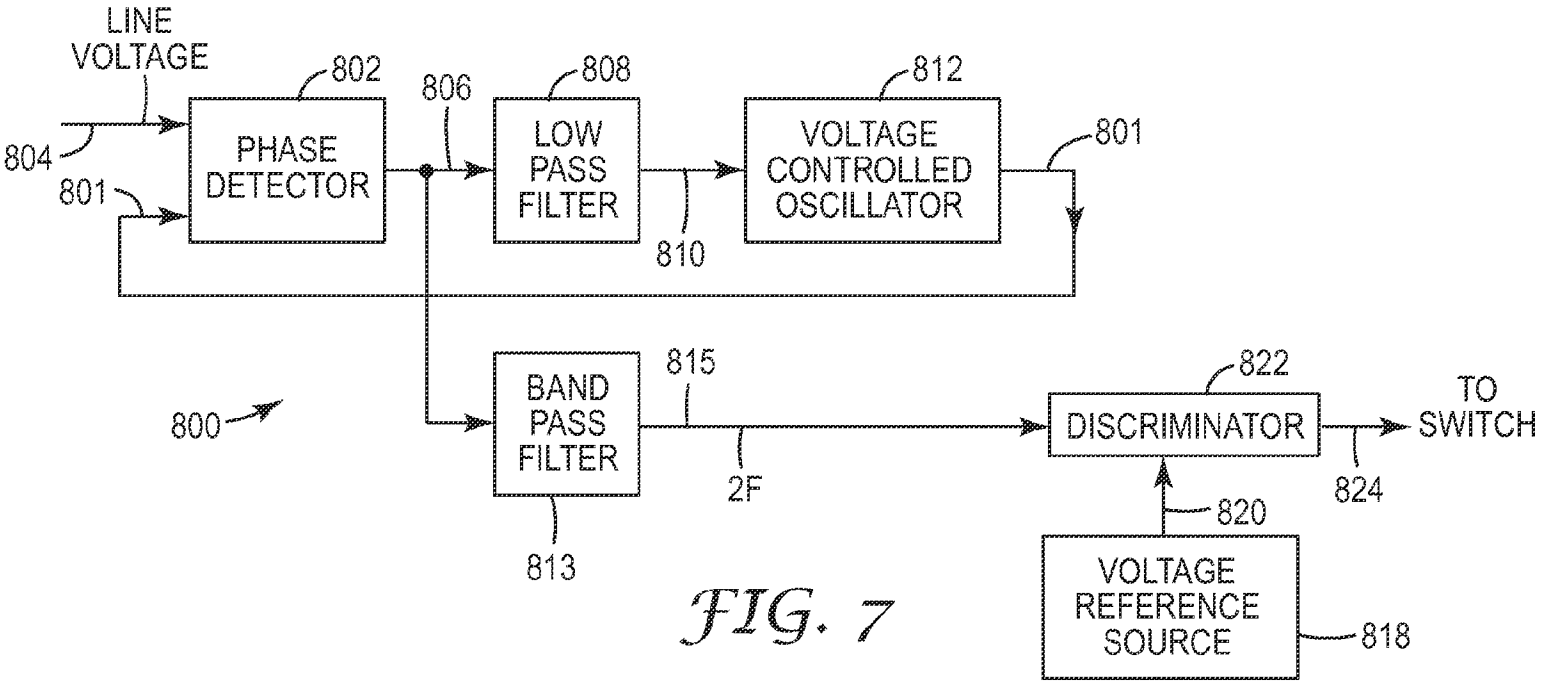
FIG. 7 illustrates a block diagram of a second switch control circuit.

FIG. 7 illustrates a block diagram of a second line voltage sensing circuit 800. The second line voltage sensing circuit 800 comprises an exemplary circuit for use as the line voltage sensing circuit 216 in FIGS. 2, 4. Alternatively, the second line voltage sensing circuit 800 comprises an exemplary circuit for use in FIGS. 2, 4 as the switch control circuit 252.

The circuit 800 comprises an analog phase detector 802. The analog phase detector 802 senses rectified or unrectified AC voltage at an input 804. According to one aspect, the voltage at input 804 comprises sine wave AC line voltage. According to another aspect, the voltage at input 804 comprises a switched waveform that fits within an envelope of a rectified or unrectified sine wave voltage as described in more detail in an example timing diagram in FIGS. 8-9. The phase detector 802 provides a phase detector output 806 that comprises a phase difference (timing difference) between a phase of the AC line voltage and a phase of a voltage controlled oscillator (VCO) output 801. According to one aspect, the phase detector 802 comprises an analog multiplier that multiplies the line voltage (with fundamental frequency F1) at input 804 times the VCO output (with fundamental frequency F2) at 801. According to this aspect, the phase detector output 806 comprises a first lower frequency spectral component centered near a difference frequency (F2–F1) and a second higher frequency spectral component centered near a sum frequency (F2+F1).

The circuit 800 comprises a low pass filter 808. The low pass filter 808 passes the lower frequency spectral component centered near the difference frequency (F2-F1) and attenuates the higher frequency component centered near the sum frequency (F2+F1) in a low pass filter output 810.

The circuit 800 comprises a voltage controlled oscillator (VCO) 812. The VCO 812 receives the low pass filter output 810. The VCO 812 generates the VCO output 801. The VCO output 801 is fed back to the phase detector 802.

The circuit 800 comprises a bandpass filter 813. The bandpass filter 813 receives the phase detector output 806. The bandpass filter 813 provides a bandpass filter output 815. The bandpass filter 813 has a passband around F2+F1 (i.e., 2F). A discriminator 822 receives the bandpass filter output 815. According to one aspect, the bandpass output 815 comprises a repetitive sinusoidal or triangular waveform at double the AC line voltage frequency that comprises the zero crossing timing information of the detected AC line voltage.

The circuit 800 comprises a voltage reference source 818. The voltage reference source 818 generates at least one voltage reference level 820. According to one aspect, the voltage reference level 820 has a relatively fixed level within the range of the bandpass filter output 815 such that there are repetitive crossings of the bandpass filter output 815 with the voltage reference level 820.

The circuit 800 comprises a discriminator circuit 822. The discriminator circuit 822 receives the integrator output 816 and the voltage reference level 820 (or multiple voltage reference levels) from the voltage reference source 818. According to one aspect, the discriminator circuit 822 comprises comparators, biasing circuits, voltage dividers and associated circuitry for comparing the bandpass filter output 815 to the voltage reference level 820 (or multiple voltage reference levels). The discriminator circuit 822 generates at least one control output 824. The control output 824 includes transitions that indicate a crossing of the bandpass filter output 815 with the voltage reference level 820.

Figure 8:
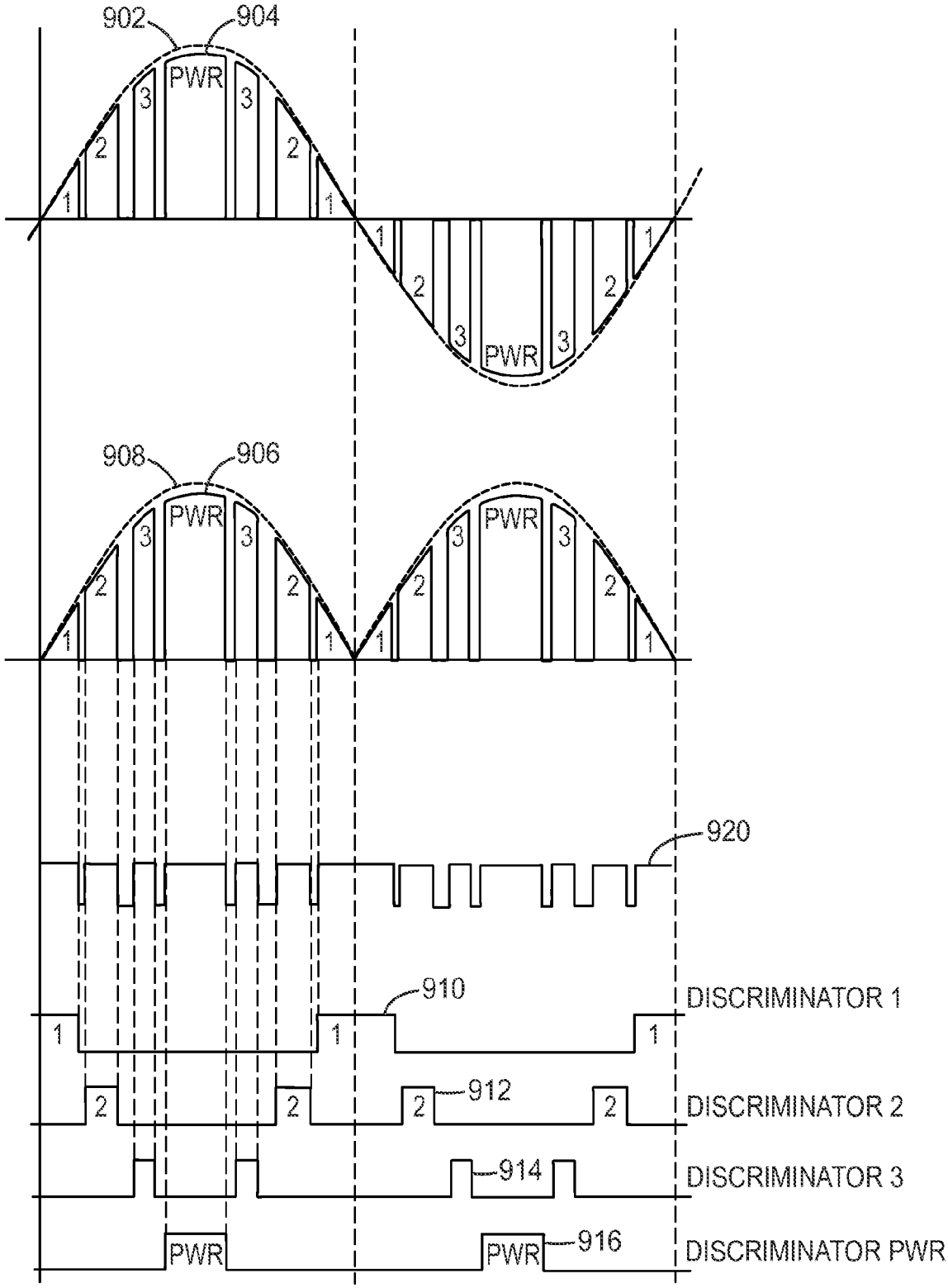
FIG. 8 illustrates a first timing diagram for an illumination system.

FIG. 8 illustrates a first timing diagram for an illumination system. In FIG. 8, vertical axes indicate amplitudes of various voltages in the illumination system, and horizontal axes indicate time. In FIG. 8, a time equal to approximately one full cycle of an AC power voltage is illustrated. A sine wave 902 (broken line) forms a modulation envelope for a switched waveform 904 (solid line) generated by an RGB dimmer such as dimmer 60 in FIG. 1 or dimmer 202 in FIGS. 2, 4. Based on comparison of a sensed sine wave AC power voltage to multiple voltage references in a line voltage sensing circuit (such as line voltage sensing circuit 216 in FIGS. 2, 4), the switched waveform 904 is generated by the line voltage sensing circuit. The switched waveform 904 is switched ON, based on voltage amplitude, during intervals 1, 2, 3 and PWR in FIG. 8.

As illustrated in FIG. 8, multiple window discriminators in the line voltage sensing circuit (such as line voltage sensing circuit 216 in FIGS. 2, 4) provide discriminator output waveforms (DISCRIMINATOR outputs 1, 2, 3, PWR) that are combined into a waveform 920 on a switch control output (such as switch control output 224 in FIGS. 2, 4).

The switched waveform 904 is coupled along a two wire circuit (such as two wire circuit 71 (FIG. 1), 241 (FIGS. 2, 5)) to a full wave rectifier (such as rectifier circuit 72 in FIG. 1, rectifier circuit 240 in FIGS. 2, 4) in an RGB bulb. The full wave rectifier provides a rectified waveform 906 (FIG. 8).

Figure 9:
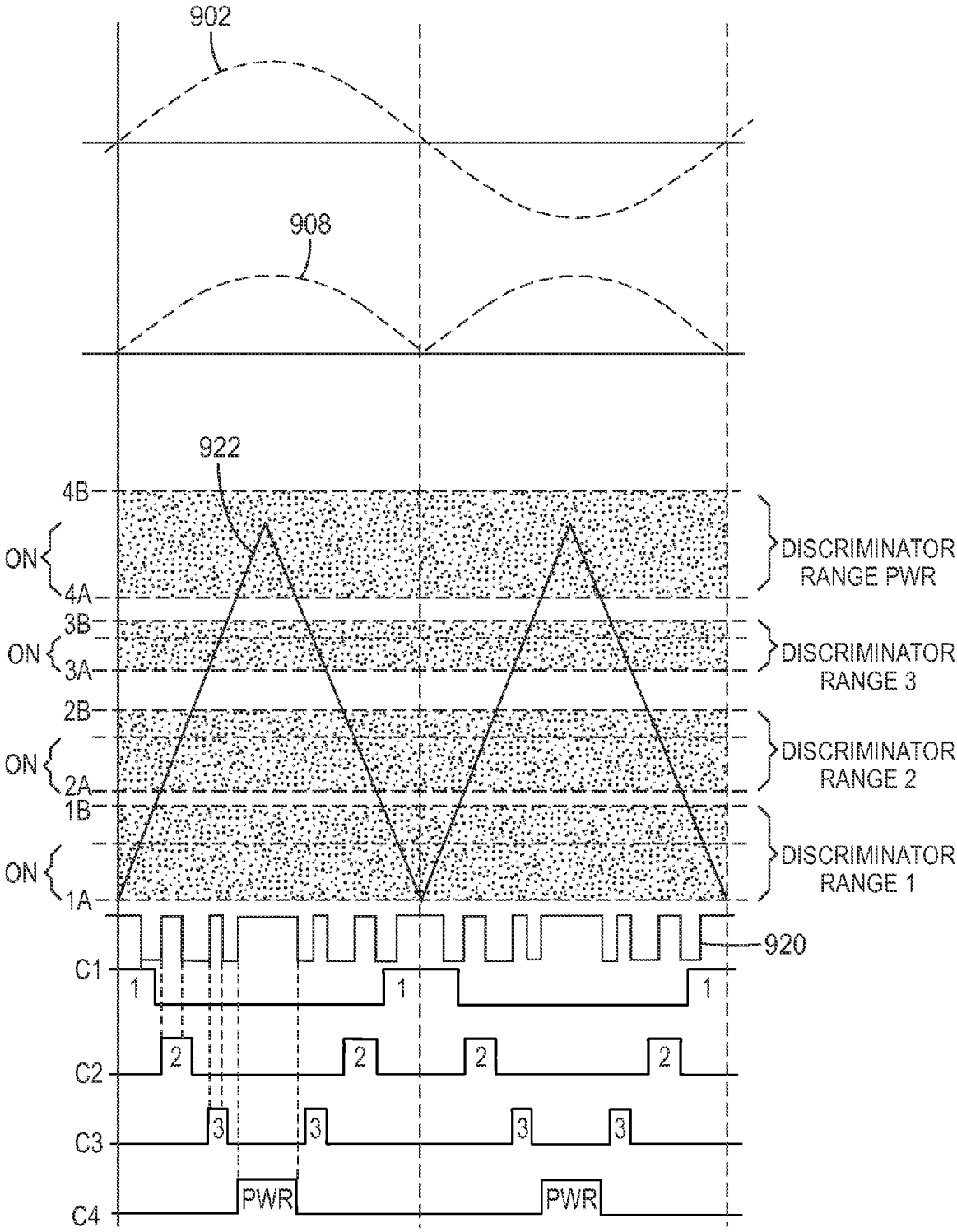
FIG. 9 illustrates a second timing diagram for an illumination system.

FIG. 9 illustrates a second timing diagram for an illumination system. FIG. 9 can be seen as an extension of the timing diagram in FIG. 8. In FIG. 9, vertical axes indicate amplitudes of various voltages in the illumination system, and horizontal axes indicate time. In FIG. 9, a time equal to approximately one full cycle of an AC power voltage is illustrated. The envelopes 902, 908 in FIG. 8 are also shown again in FIG. 9 for a timing reference.

In FIG. 9, a triangular wave 922 represents a voltage output of an integrator (such as the integrator 712 in FIG. 6 or the bandpass filter 813 in FIG. 7, for example) inside a switch control circuit 94 in FIG. 1 or inside a line voltage sensing circuit 216 or inside a switch control circuit 252. Reference levels 1A, 1B, 2A, 2B, 3A, 3B, 4A, 4B in FIG. 9 as produced by a voltage reference source (such as voltage reference source 818 in FIG. 7) are illustrated as broken horizontal lines in FIG. 9. The reference levels define voltage level ranges or bands (indicated by a stippled background in FIG. 9) in which the illumination system is conditionally able to deliver power to a series circuit of LEDs (reference 1A-1B for color 1, reference 2A-2B for color 2, reference 3A-3B for color 3, reference 4A-4B for power). While the illumination system is able to deliver power in these intervals, the interval during which the power is actually delivered as indicated in FIG. 9 as "ON") is further limited by a switch control output waveform 920 in FIG. 9 because the transistors 226, 228 (FIG. 2) in the RGB dimmer circuit are in series with the RGB bulb circuit.

Crossover points of the triangle wave 922 and the reference levels 1A, 1B, 2A, 2B, 3A, 3B, 4A as sensed by a discriminator (such as discriminator 720 in FIG. 6 or discriminator 822 in FIG. 7) control switching points of discriminator outputs 910, 912, 914, 916 shown in FIG. 8.

In FIG. 9, the ranges (also called windows) 1A-1B, 2A-2B, 3A-3B, 4A-4B are set by the switch control circuit in the RGB bulb, and the ON ranges are set by the line voltage sensing circuit in the RGB dimmer. Both ranges are based on line voltage amplitudes, and the ON ranges are set within the ranges 1A-1B, 2A-2B, 3A-3B, 4A-4B. There are guard bands between the ranges 1B, 2A-2B, 3A-3C, 4A to ensure that no two series strings of LEDS are on at the same amplitude.

Figure 10:
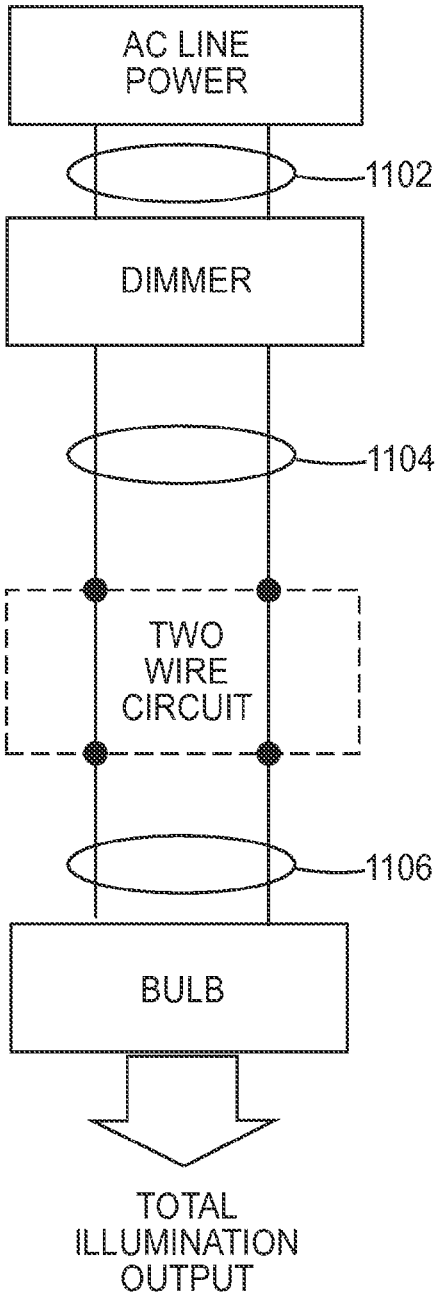
FIG. 10 illustrates a schematic of connection points for noise suppression in an illumination system.
Figure 11:
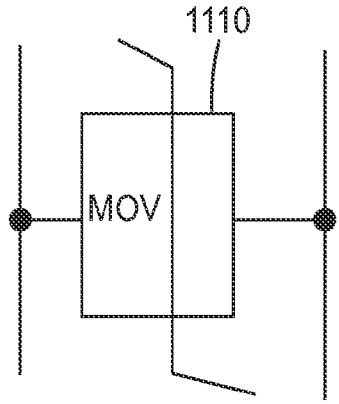
FIG. 11 illustrates a schematic of a metal oxide varistor (MOV).
Figure 12:
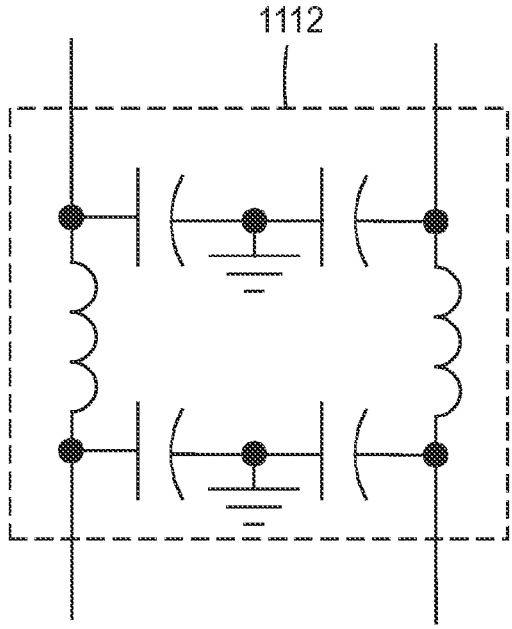
FIG. 12 illustrates a schematic diagram of a noise filter.

FIG. 10 illustrates a schematic of connection points 1102, 1104, 1106 for noise suppression in an illumination system. Noise suppression circuits such as a metal oxide varistor (MOV) 1110 shown in FIG. 11 or a pi filter 1112 shown in FIG. 12 can be inserted at connection points 1102, 1104, 1106 for suppression of noise. Other noise suppression devices are also contemplated for use in the illumination systems.

Figure 13:
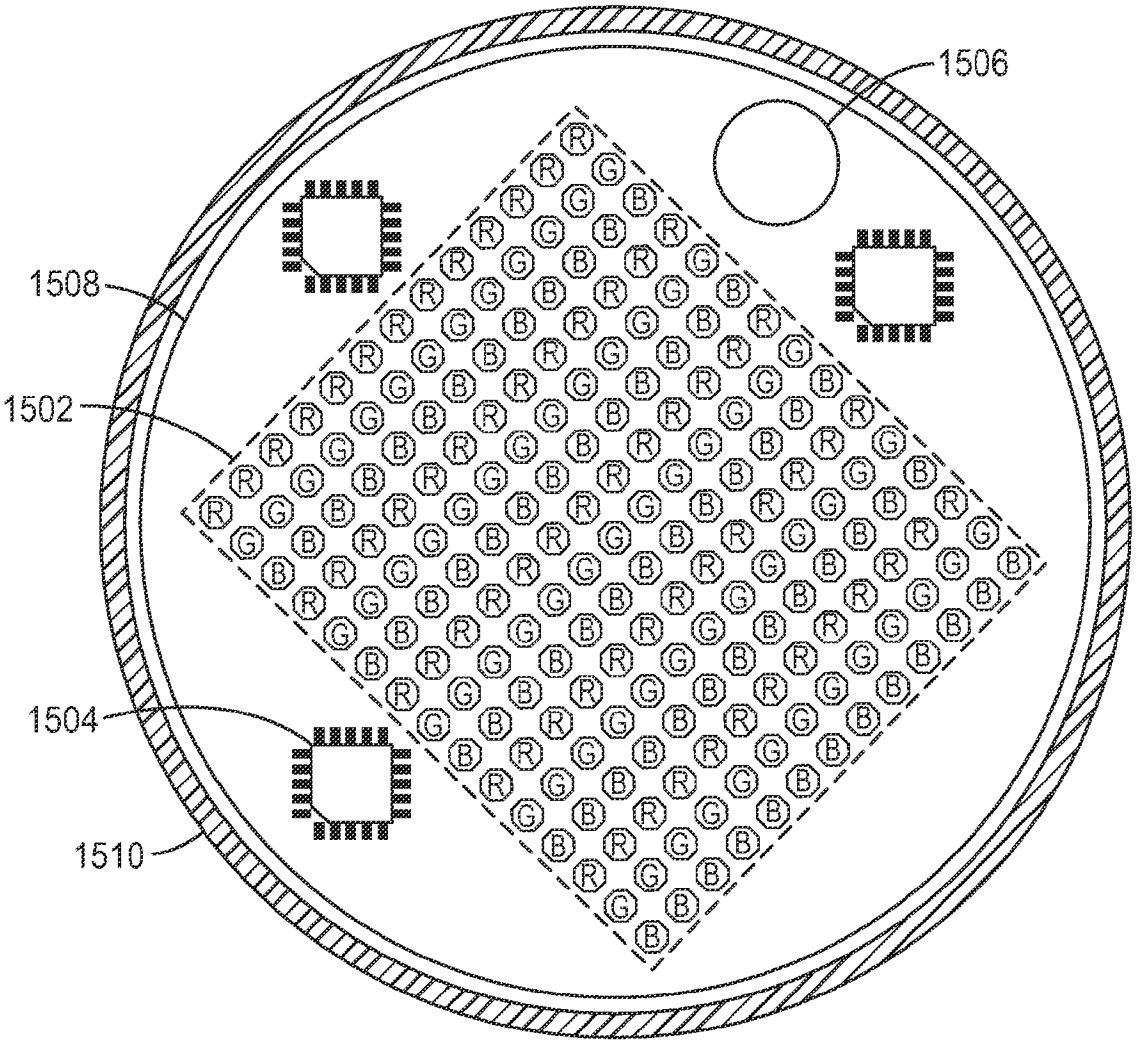
FIG. 13 illustrates a cross-sectional view of a red-green-blue (RGB) bulb that includes an array of series of light emitting diodes on a common substrate.

FIG. 13 illustrates a pictorial drawing of an array of series of light emitting diodes 1502 on a common substrate 1508. A bridge rectifier 1506 and other circuits 1504 are also mounted on the substrate. According to one aspect, the substrate 1508 is round and fits into a round or globular bulb envelope 1510 comprising a layer of optical diffusion material. According to another aspect, two substrates such as substrate 1508 are arranged back-to-back inside a globular bulb envelope formed of optical diffusion material. According to another aspect, the bulb envelope is mounted to a threaded bulb base that includes contacts for a two wire circuit. According to another aspect, the bulb can include other optical devices such as lenses, mirrors and the like. Other shapes of bulb envelopes and substrates, and other shapes of bulb electrical connectors are also contemplated.

Figure 14:
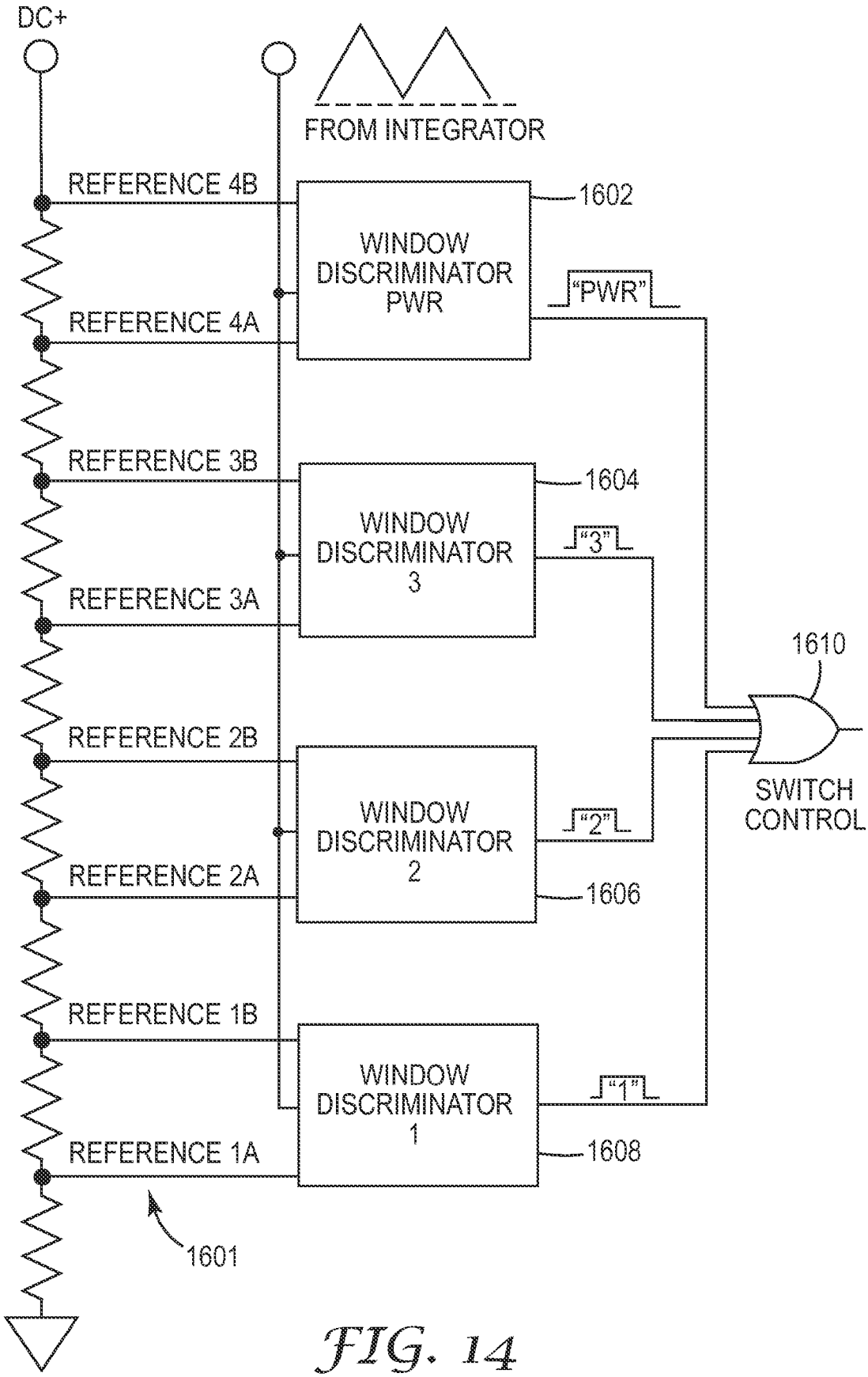
FIG. 14 illustrates a schematic diagram of a voltage reference source and a discriminator such as those shown in FIG. 6 or 7.

FIG. 14 illustrates a schematic diagram of a voltage reference source (such as voltage reference source 716 in FIG. 6) and a discriminator (such as discriminator 720 in FIG. 6). The voltage reference source comprises a series resistive circuit (resistive ladder) 1601. The discriminator comprises window discriminator circuits 1602, 1604, 1606, 1608 and an OR gate 1610. The OR gate 1610 controls a switch output such as switch output 224 in FIGS. 2 and 4. Other known types of voltage reference sources and discriminators or comparators are also contemplated.

Figure 15:
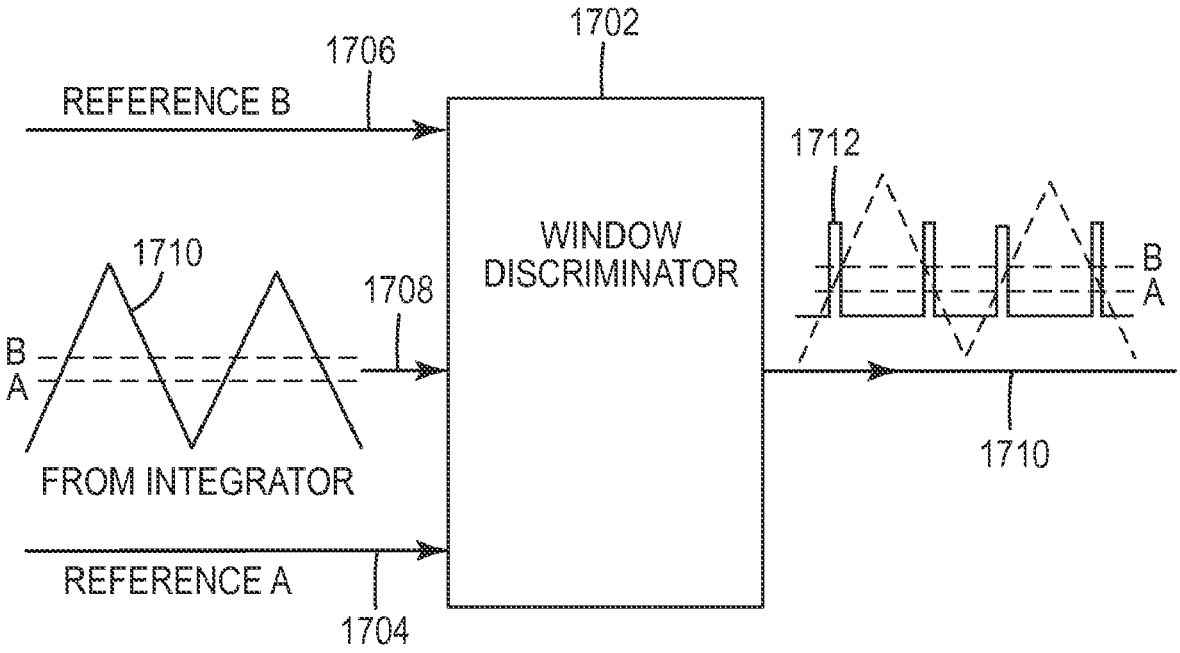
FIG. 15 illustrates an exemplary embodiment of a window discriminator such as that shown in FIG. 14.

FIG. 15 illustrates a window discriminator circuit 1702. The window discriminator circuit 1702 receives reference voltage level A at 1704 and reference voltage level B at 1706. The window discriminator circuit 1702 receives a sensed voltage input 1708. As illustrated in FIG. 15, the sensed voltage input 1708 can comprise, for example, a triangular wave 1710. The triangular wave 1710 intersects with reference voltage levels A and B as illustrated. The range of voltage levels between reference voltage levels A and B are referred to here as an amplitude window. The window discriminator 1702 generates a window discriminator output 1710. The window discriminator output 1710 is off (at a low logic level) except when the amplitude of the sensed voltage input 1708 is in the amplitude window between reference voltage levels A and B. When the amplitude of the sensed voltage input 1708 in the amplitude window between reference voltage levels A and B, then the window discriminator output 1710 is on (at a high logic level). When the sensed voltage input 1708 comprises a triangular wave 1710 as illustrated, the window discriminator output 1710 comprises a pulse train 1712 as illustrated.

Features described with reference to one of the above described embodiments can be appropriately adapted to other embodiments. Either grounded or ungrounded power mains can be used. 120 VAC residential circuits with one line grounded ("neutral") can be used. 208 VAC sources in which neither conductor is grounded can also be used.

The RGB bulb can be connected to mains power without the use of an RGB dimmer. The AC power source can provide a sine wave (from the mains) or a "vestigial sine wave" switched ON and OFF at selected amplitudes of a complete sine wave by an RGB dimmer.

The colors 1, 2, N of the LED's can be colors in various color spaces. The emitting diodes may include phosphors. In some cases one of the colors may be a white. The optical mixing cavity can include reflectors, refractors, phosphors, and can include known components such as beam splitters, mirrors, lenses, polarizers, light tunnels, diffusers, optical fibers, optical films, multilayer optical films (MOF) and Vikuiti Enhanced Specular Reflection (ESR) films available from 3M Company, St. Paul, Minn.), and other known optical components. The optical mixing cavity does not substantially combine the colors 1, 2, N, and the separate color components do not substantially overlap in an amplitude sense as illustrated in FIG. 9. There may be some limited combining if the emitting diodes or the "emission director" include phosphors with long persistence. The viewer has vision persistence that is longer than the sequence, and the sequential output is perceived as combined colors by the viewer because the frequency used substantially exceeds the chromatic critical flicker frequency.

Emitting diode currents are either switched ON or switched OFF. There is no use of analog current amplitude modulation to control amounts of each color. There are no "lossy" components in series with the multiple series of emitting diodes. Electronic switches in the form of transistors (MOSFETS) are substantially lossless (loss free) so that the control circuit can be implemented with very high efficiency, well over 90%.

Although the present invention has been described with reference to preferred embodiments, workers skilled in the art will recognize that changes may be made in form and detail without departing from the spirit and scope of the invention.

What is claimed is:

1. A method, comprising:

rectifying AC power from an AC power source with an AC cycle time to provide rectified power;

amplitude partitioned switching in a switching sequence of at least first, second and third currents from the rectified power, the switching sequence being locked to the AC cycle time by sensing an amplitude of at least one of the AC power and the rectified power; and conducting the first, second and third currents through corresponding first, second and third series of color light emitting devices that emit an illumination sequence of corresponding first, second and third color emissions that repeats at least twice each AC cycle time.

2. The method of claim 1, comprising:

combining the illumination sequence in an optical mixing cavity; and providing a combined illumination output from the optical mixing cavity.

3. The method of claim 1, comprising:

providing the AC power from a connection to a power main.

4. The method if claim 1, comprising:

providing the AC power from a dimmer.

5. The method of claim 4 wherein the switching sequence is controlled by:

sensing sequenced start levels Of each of the first, second and third currents as a function of a voltage amplitude of the AC power source; and sensing sequenced stop limit levels each of the first, second and third currents as a function of a voltage amplitude of the AC power source, the start and stop levels defining available ON amplitude windows for each of the first, second and third currents.

6. The method of claim 5 wherein the switching sequence further comprises:

turning off at least one of the first, second and third currents before its respective stop limit level under control of the dimmer.

7. The method of claim 1 and further comprising:

locking the switching sequence to the AC cycle time during an amplitude zero crossing of the AC power source.

8. An illumination apparatus, comprising:

a rectifier circuit couplable to AC power with an AC cycle time, the rectifier circuit providing rectified power;

a switching circuit that provides switching of at least first, second and third currents, the switching being locked to the AC cycle time by sensing an amplitude of at least one of the AC power and the rectified power; and at least first, second and third series of color light emitting devices that receive the corresponding first, second and third currents and that emit a sequence of corresponding first, second and third color emissions that repeats at least twice each AC cycle time.

9. The illumination apparatus of claim 8, and further comprising:

an optical cavity that manages the first, second and third color optical emissions along a common illumination path to an illuminated space.

10. The illumination apparatus of claim 8, and further comprising:

a switch control circuit that comprises a voltage sense input coupled to one of the AC power and the rectified power, the switch control circuit controlling the switching circuit.

11. The illumination apparatus of claim 8 and further comprising:

a dimmer that provides the AC power.

12. The illumination apparatus of claim 11, wherein the dimmer comprises:

a line voltage sensing circuit that senses mains AC voltage from a mains power source and that provides a switch control output; and a solid state AC switch coupling the mains AC voltage to the rectifier as a function of the switch control output, the solid state AC switch providing at least first, second and third ON intervals during each half cycle of the AC cycle time.

13. The illumination apparatus of claim 11 and further comprising a two wire circuit coupling the dimmer to the rectifier.

14. An illumination apparatus, comprising:

a rectifier circuit couplable to AC power with an AC cycle time, the rectifier circuit providing rectified power;

a switch control circuit that comprises a voltage sense input sensing an amplitude of one of the AC power and the rectified power, the switch control circuit providing switch control outputs that are locked to the AC cycle time;

a switching circuit that switches at least first, second and third currents; and at least first, second and third series of color light emitting devices that receive the corresponding first, second and third currents and that emit a sequence of corresponding first, second and third color emissions that repeats at least twice each AC cycle time.

15. The illumination apparatus of claim 14 wherein the switch control circuit comprises:

an integrator providing an integrator output;

a voltage reference source providing multiple voltage references; and a discriminator that receives the integrator output and the multiple voltage references, the discriminator generating the switch control outputs.

16. The illumination apparatus of claim 15, further comprising:

a zero crossing detector that provides a zero crossing detector output including zero crossing information; and a phase lock loop that receives the zero crossing detector output and that generates a phase lock loop output that couples to the integrator.

17. The illumination apparatus of claim 15, further comprising:

a phase detector that provides a phase detector output including zero crossing information;

a low pass filter that receives the phase detector output and that provides a low pass filter output; and a voltage controlled oscillator that receives the low pass filter output, the voltage controlled oscillator providing a voltage controlled oscillator output that couples to the phase detector.

18. The illumination apparatus of claim 14 wherein the first, second and third color emissions comprise red, green and blue emissions.

19. The illumination apparatus of claim 14 and further comprising:

an optical cavity that manages the first, second and third color emissions to an illumination space.

20. The illumination apparatus of claim 19 wherein the optical cavity has the shape of light bulb.

* * * * *

UNITED STATES PATENT AND TRADEMARK OFFICE

CERTIFICATE OF CORRECTION

PATENT NO. : 7,863,831 B2
APPLICATION NO. : 12/137667
DATED : January 4, 2011
INVENTOR(S) : Martin J. Vos It is certified that error appears in the above-identified patent and that said Letters Patent is hereby corrected as shown below:

Column 3
Line 48; delete "C3, . . . CN" and insert -- C3, . . ., CN --, therefor.

Column 11
Line 13; Claim 4, delete "if" and insert -- of --, therefor.
Line 17; Claim 5, delete "Of" and insert -- of --, therefor.

Signed and Sealed this
Fifth Day of April, 2011

David J. Kappos

David J. Kappos
*Director of the United States Patent and Trademark Office*